US009126161B2

(12) United States Patent
Lee et al.

(10) Patent No.: US 9,126,161 B2
(45) Date of Patent: Sep. 8, 2015

(54) FLUID RECEIVING CHAMBER, MICROFLUIDIC DEVICE INCLUDING FLUID RECEIVING CHAMBER, AND FLUID MIXING METHOD

(75) Inventors: June-young Lee, Anyang-si (KR); Chin-sung Park, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1153 days.

(21) Appl. No.: 12/771,243

(22) Filed: Apr. 30, 2010

(65) Prior Publication Data

US 2011/0056565 A1 Mar. 10, 2011

(30) Foreign Application Priority Data

Sep. 10, 2009 (KR) ..... 10-2009-0085496

(51) Int. Cl.

| | |
|---|---|
| ***B01F 15/02*** | (2006.01) |
| ***B01F 13/00*** | (2006.01) |
| ***B01F 3/08*** | (2006.01) |
| ***B01F 5/00*** | (2006.01) |
| ***B01L 3/00*** | (2006.01) |

(52) U.S. Cl.

CPC ..... *B01F 3/0861* (2013.01); *B01F 5/0068* (2013.01); *B01L 3/502715* (2013.01); *B01L 2200/027* (2013.01); *B01L 2200/04* (2013.01); *B01L 2200/16* (2013.01); *B01L 2300/0867* (2013.01); *B01L 2400/0487* (2013.01)

(58) Field of Classification Search

CPC ..... B01F 5/10; B01F 13/0059; B01J 19/0093

USPC ..... 366/137.1, 340, 341, 136; 422/243, 422/603, 502, 504, 523

See application file for complete search history.

(56) References Cited

U.S. PATENT DOCUMENTS

| | | | | |
|---|---|---|---|---|
| 2,135,261 | A * | 11/1938 | Rosfmait | 366/136 |
| 2,795,403 | A * | 6/1957 | Mead | 366/107 |
| 2,989,979 | A * | 6/1961 | Karlson | 422/261 |
| 4,416,610 | A * | 11/1983 | Gallagher, Jr. | 366/167.1 |
| 6,326,211 | B1 | 12/2001 | Anderson et al. | |
| 7,238,323 | B2 | 7/2007 | Knapp et al. | |
| 2003/0034306 | A1 | 2/2003 | Schulte et al. | |
| 2008/0017306 | A1 * | 1/2008 | Liu et al. | 156/297 |

FOREIGN PATENT DOCUMENTS

| | | | |
|---|---|---|---|
| JP | 2003-121311 | A | 4/2003 |
| KR | 1020030090636 | A | 11/2003 |
| KR | 1020070106239 | A | 11/2007 |

* cited by examiner

*Primary Examiner* — Tony G Soohoo
*Assistant Examiner* — Anshu Bhatia
(74) *Attorney, Agent, or Firm* — Leydig, Voit & Mayer, Ltd.

(57) ABSTRACT

A fluid receiving chamber including a fluid inlet hole through which a fluid flows from outside, an inner space which contains the fluid, a fluid supply hole through which the fluid flows from the fluid inlet hole to the inner space, and a fluid outlet hole through which the fluid contained in the inner space is discharged to the outside, where the fluid supply hole is disposed above the fluid outlet hole, and the fluid is supplied to the inner space through the fluid supply hole by gravity.

12 Claims, 5 Drawing Sheets

FLUID RECEIVING CHAMBER, MICROFLUIDIC DEVICE INCLUDING FLUID RECEIVING CHAMBER, AND FLUID MIXING METHOD

CROSS-REFERENCE TO RELATED APPLICATION

This application claims priority to Korean Patent Application No. 10-2009-0085496, filed on Sep. 10, 2009, and all the benefits accruing therefrom under 35 U.S.C. §119, the content of which in its entirety is herein incorporated by reference.

BACKGROUND

1) Field

One or more embodiments of the general inventive concept relate to a fluid receiving chamber which receives a fluid, a microfluidic device including the fluid receiving chamber and a fluid mixing method using the microfluidic device.

2) Description of the Related Art

Microfluidic devices are used for various functions, such as performing a biochemical reaction using a bimolecular sample and/or detecting a reaction result, for example. Microfluidic devices may be implemented as a lab-on-a-chip, or on a rotatable disk, such as a lab-on-a-disk, for example. A microfluidic device typically includes a chamber that houses a fluid, a channel through which the fluid is transported, a valve that controls flow of the fluid and various functional units that perform predetermined functions using the fluid.

To uniformly mix various kinds of fluids in the chamber of the microfluidic device, the microfluidic device may be shaken, such as by ultrasonic vibration, mechanical vibration or by being rotated, or air may be provided to the chamber of the microfluidic device.

SUMMARY

One or more embodiments of the present invention include a fluid receiving chamber that uniformly mixes fluids flowing in by a generated vortex of the fluids resulting from falling, a microfluidic device including the fluid receiving chamber, and a fluid mixing method using the microfluidic device.

One or more embodiments of the present invention include a fluid receiving chamber that hinders generation of bubbles in a mixing process and reduces fluid waste, a microfluidic device including the fluid receiving chamber, and a fluid mixing method using the microfluidic device.

Provided is a fluid receiving chamber, which includes: a fluid inlet hole through which a fluid flows from outside; an inner space which contains the fluid; a fluid supply hole through which the fluid flows from the fluid inlet hole to the inner space; and a fluid outlet hole through which the fluid contained in the inner space is discharged to the outside, where the fluid supply hole is disposed above the fluid outlet hole, and the fluid is supplied to the inner space through the fluid supply hole by gravity.

Provided also is a microfluidic device, which includes: the fluid receiving chamber described above; and a chamber mounting member including a mounting member on which the fluid receiving chamber is disposed, a fluid supply channel connected to the fluid inlet hole and through which a fluid is supplied to the fluid receiving chamber, a fluid discharge channel connected to the fluid outlet hole and through which the fluid is discharged from the fluid receiving chamber, a supply control valve disposed in the fluid supply channel and which controls a flow of the fluid in the fluid supply channel, and a discharge control valve disposed in the fluid discharge channel and which controls a flow of the fluid in the fluid discharge channel.

Also provided is a microfluidic device, which includes: a plurality of fluid receiving chambers, each fluid receiving chamber of the plurality of fluid receiving chambers including a fluid inlet hole through which a fluid flows from outside, an inner space which contains the fluid, a fluid supply hole through which the fluid flows from the fluid inlet hole to the inner space, and a fluid outlet hole through which the fluid contained in the inner space is discharged to the outside, where the fluid supply hole is disposed above the fluid outlet hole and the fluid is supplied to the inner space through the fluid supply hole by gravity; and a chamber mounting member including a plurality of mounting members on which the plurality of fluid receiving chambers are disposed, a fluid supply channel connected to the fluid inlet hole of a first fluid receiving chamber of the plurality of fluid receiving chambers and through which the fluid is supplied to the first fluid receiving chamber, a fluid discharge channel connected to the fluid outlet hole of the first fluid receiving chamber and through which the fluid is discharged from the first fluid receiving chamber, a connection channel which connects the fluid outlet hole of the first fluid receiving chamber and the fluid inlet hole of a second fluid receiving chamber of the plurality of fluid receiving chambers, a supply control valve disposed in the fluid supply channel and which controls a flow of the fluid in the fluid supply channel, a discharge control valve disposed in the fluid discharge channel and which controls a flow of the fluid in the fluid discharge channel, and a connection control valve disposed in the connection channel and which controls a flow of the fluid in the connection channel.

In one or more embodiments, each of the fluid receiving chambers may further include an inner channel which connects the fluid inlet hole and the fluid supply hole of the corresponding fluid receiving chamber, and the inner channel is disposed in a wall of the fluid receiving chamber.

In one or more embodiments, the fluid supply hole may have a nozzle-like shape having a diameter which decreases in a direction of a flow of the fluid therethrough.

In one or more embodiments, each of the plurality of the fluid receiving chambers may include a concave bottom surface having a funnel-like shape, and the fluid outlet hole of the each of the plurality of fluid receiving chamber is disposed at a lowest point of the concave bottom surface.

Provided also is a method of mixing fluid using a plurality of fluid receiving chambers, each of which includes a fluid inlet hole through which the fluid flows from outside, an inner space which contains the fluid, a fluid supply hole through which the fluid flowing from the fluid inlet hole to the inner space, and a fluid outlet hole through which the fluid contained in the inner space is discharged to the outside, the fluid supply hole being disposed above the fluid outlet hole, and the fluid being supplied to the inner space through the fluid supply hole by gravity, includes: first mixing a plurality of kinds of fluids by loading the fluids through the fluid inlet hole of a first fluid receiving chamber of the plurality of fluid receiving chambers and supplying the fluids to the inner space of the first fluid receiving chamber; first discharging the first mixed fluids through the fluid outlet hole of the first fluid receiving chamber; and second mixing the first mixed fluids by loading the discharged first mixed fluids through the fluid inlet hole of a second fluid receiving chamber of the plurality of fluid receiving chambers and supplying the loaded first mixed fluids to the inner space of the second fluid receiving chamber.

In one or more embodiments, the fluid mixing method may further include: second discharging the fluids mixed by the second mixing through the fluid outlet hole of the second fluid receiving chamber; and third mixing the fluids discharged by the second discharging by loading the fluids discharged by the second discharging through the fluid inlet hole of the first fluid receiving chamber and supplying the loaded fluids to the inner space of the first fluid receiving chamber.

In one or more embodiments, the fluid mixing method may further include: second discharging the fluids mixed by the second mixing through the fluid outlet hole of the second fluid receiving chamber; and third mixing the fluids discharged by the second discharging by loading the fluids discharged in the second discharging through the fluid inlet hole of a third fluid receiving chamber of the plurality of fluid receiving chambers and supplying the loaded fluids to the inner space of the third fluid receiving chamber.

BRIEF DESCRIPTION OF THE DRAWINGS

The above and/or other aspects and features of this disclosure will become more apparent by describing in further detail embodiments thereof with reference to the accompanying drawings, in which.

DETAILED DESCRIPTION

Figure 1:
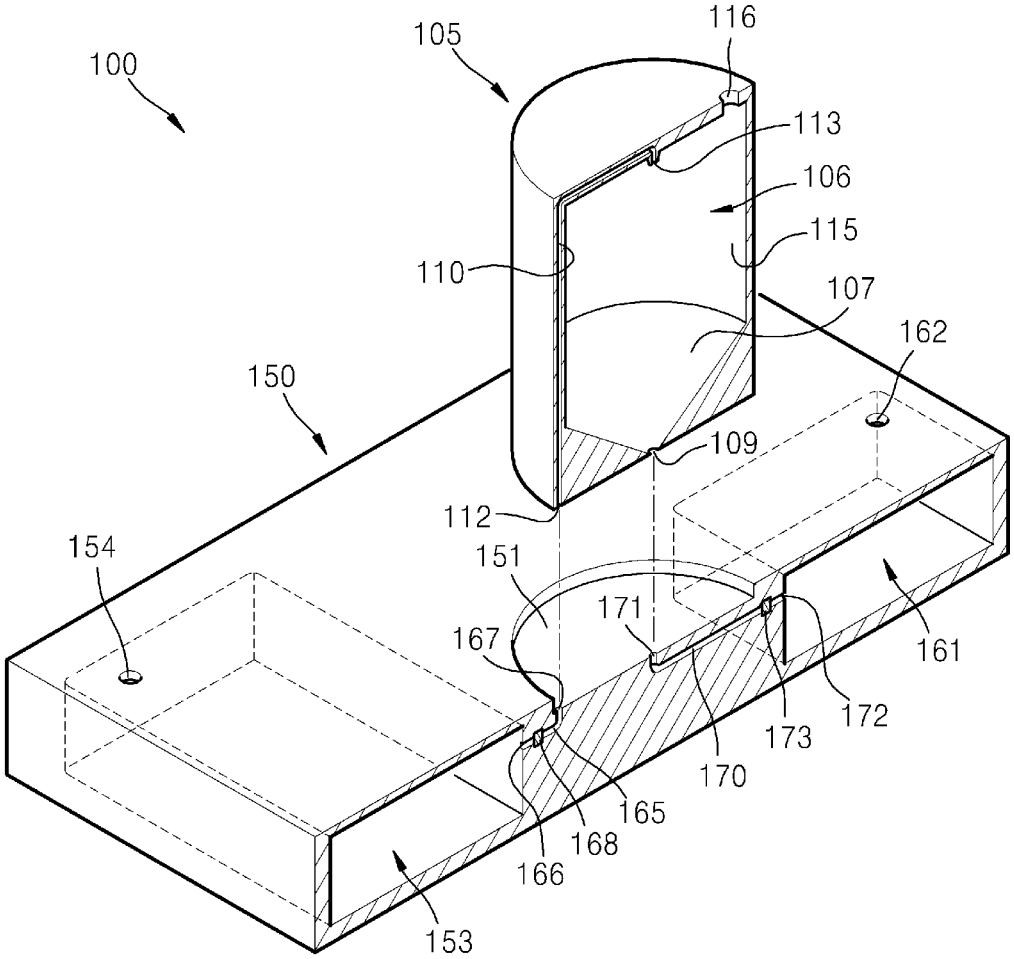
FIG. 1 is an exploded cross-sectional perspective view of an embodiment of a microfluidic device.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the general inventive concept will be described in further detail with reference to the accompanying drawings.

Figure 2:
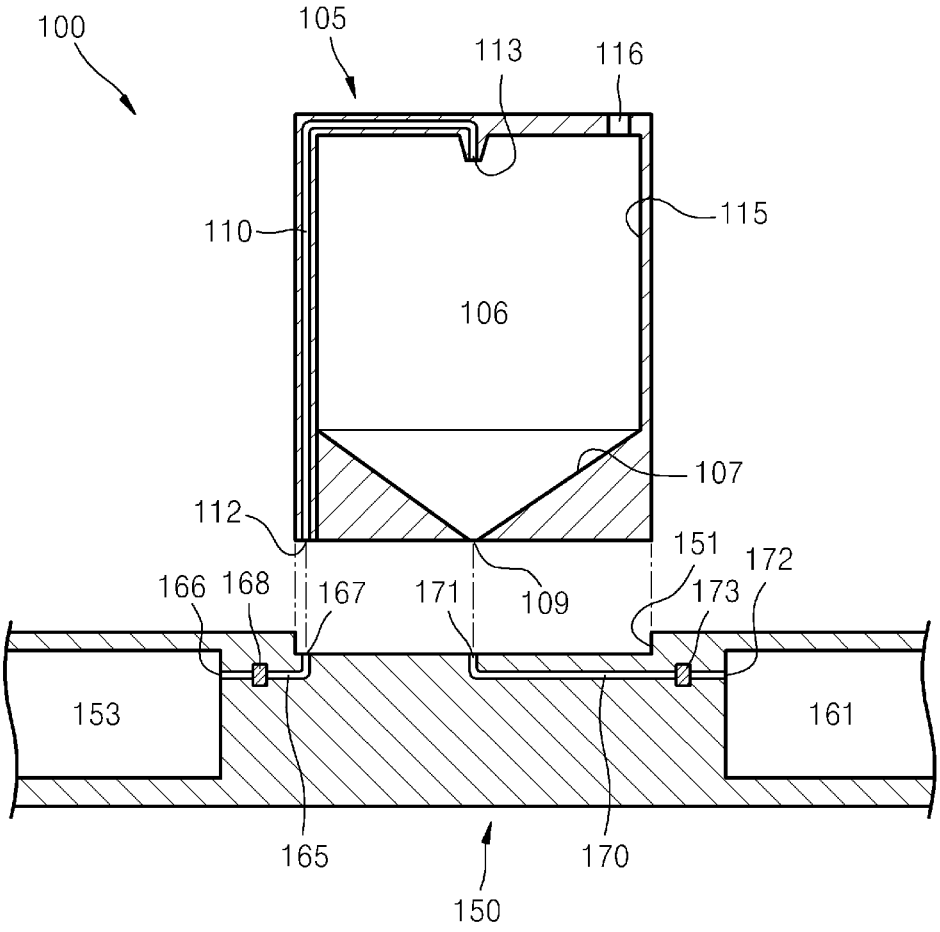
FIG. 2 is an exploded, longitudinal cross-sectional view of the microfluidic device of FIG. 1.

FIG. 1 is an exploded cross-sectional perspective view of an embodiment of a microfluidic device 100, and FIG. 2 is an exploded, longitudinal cross-sectional view of the microfluidic device 100 of FIG. 1.

Referring to FIGS. 1 and 2, the microfluidic device 100 may include a fluid receiving chamber 105, and a chamber mounting member 150 on which the fluid receiving chamber 105 is disposed, e.g., mounted. The fluid receiving chamber 105 may include an inner space 106 which contains a fluid. In an embodiment, the fluid receiving chamber 105 may be cylindrical in shape, but not being limited thereto. The fluid receiving chamber 105 may include a fluid inlet hole 112 which is formed on a bottom end of the fluid receiving chamber 105 and through which a fluid flows from outside of the fluid receiving chamber 105, a fluid supply hole 113 through which the fluid from the fluid inlet hole 112 is supplied to the inner space 106, and a fluid outlet hole 109 through which the fluid contained in the inner space 106 flows to the outside of the fluid receiving chamber 105.

The fluid receiving chamber 105 may include an inner channel 110 that connects the fluid inlet hole 112 to the fluid supply hole 113. The inner channel 110 is disposed within, e.g., embedded in, a wall of the fluid receiving chamber 105. The fluid supply hole 113 is formed in a top surface of the fluid receiving chamber 105. The fluid that flows from the fluid inlet hole 112 to the fluid supply hole 113 through the inner channel 110 may drop toward a bottom surface 107 by a pressure pushing the fluid and by gravity. The fluid supply hole 113 may be located above the fluid outlet hole 109.

The fluid may be pushed to the fluid supply hole 113 by loading gas into the inner channel 110. When the gas is loaded, the gas passes through the fluid supply hole 113 and is separated from the fluid, and then immediately flows to the outside of the fluid receiving chamber 105 through a ventilation hole 116 formed in the top surface of the fluid receiving chamber 105. Accordingly, generation of bubbles in the inner space 106 is effectively prevented. In addition, overflow of fluid through the ventilation hole 116, which may be caused by the generation of bubbles, or fluid remaining on the inner surface 115 of the fluid receiving chamber 105, which results in an increase in fluid waste, is also effectively prevented. The fluid supply hole 113 has a nozzle-like shape having a diameter which decreases in a direction of flow of the fluid, and the amount of the flow of the fluid into the inner space 106 is thereby finely adjusted and fluid waste is substantially reduced.

In an embodiment, the bottom surface 107 of the fluid receiving chamber 105 may be concaved and have a funnel-like shape, and a fluid outlet hole 109 may be formed at the lowest point of the bottom surface 107. Thus, bouncing of the fluid dropping from the fluid supply hole 113 by the bottom surface 107 to the inner surface 115 is effectively prevented, and when the fluid flows toward the outside of the fluid receiving chamber 105 through the fluid outlet hole 109, the amount of residual fluid may be substantially reduced.

The chamber mounting member 150 of the microfluidic device 100 may include a mounting member 151 on which the bottom end of the fluid receiving chamber 105 may be disposed, e.g., fixed and mounted, a supply chamber 153 that contains a fluid supplied to the fluid receiving chamber 105, and a drain chamber 161 that contains a fluid flown from the fluid receiving chamber 105. The supply chamber 153 may have an opening 154 through which a fluid may be provided or the pressure inside the supply chamber 153 and the pressure outside the supply chamber 153 may be maintained in equilibrium. The drain chamber 161 may have an opening 162 through which a fluid flows out and the pressure inside the drain chamber 161 or the pressure outside the drain chamber 161 may be maintained in equilibrium.

In an embodiment, the chamber mounting member 150 may include a fluid supply channel 165 that connects the supply chamber 153 and the fluid inlet hole 112 of the fluid receiving chamber 105, and a fluid discharge channel 170 that connects the drain chamber 161 and the fluid outlet hole 109. An inlet hole 166, through which the fluid supply channel 165 may be connected to the supply chamber 153, is formed at an end of the fluid supply channel 165 and an outlet hole 167, which may be aligned with the fluid inlet hole 112 when the fluid receiving chamber 105 is disposed on the mounting member 151, is formed at the other end of the fluid supply channel 165. An outlet hole 172 through which the fluid discharge channel 170 is connected to the drain chamber 161 is formed at an end of the fluid discharge channel 170; and an inlet hole 171, which may be aligned with the fluid outlet hole 109 when the fluid receiving chamber 105 is disposed on the mounting member 151 is formed at the other end of the fluid discharge channel 170. The fluid supply channel 165 may include a supply control valve 168 that controls flow of the fluid in the supply channel 165, e.g., opens or closes the fluid supply channel 165, and the fluid discharge channel 170 may include a discharge control valve 173 that controls a flow of the fluid in the fluid discharge channel 170, e.g., opens or closes the fluid discharge channel 170.

When a fluid is loaded into the supply chamber 153, the supply control valve 168 may be opened, the discharge control valve 173 may be closed, and the compressed air may be loaded through the opening 154 such that the fluid contained in the supply chamber 153 flows into the inner space 106 through the fluid supply channel 165, the inner channel 110 and the fluid supply hole 113. If various kinds of fluids flow into the supply chamber 153, a vortex may occur when the fluids drop through the fluid supply hole 113, and the various kinds of fluids are thereby substantially uniformly mixed.

The fluid contained in the fluid receiving chamber 105 may be used for various purposes including various biochemical experiments, diagnosis and detection for specific components, for example. When a target process is completely performed, the discharge control valve 173 may be opened and the fluid in the inner space 106 is thereby discharged into the drain chamber 161 through the fluid discharge channel 170.

Figure 3:
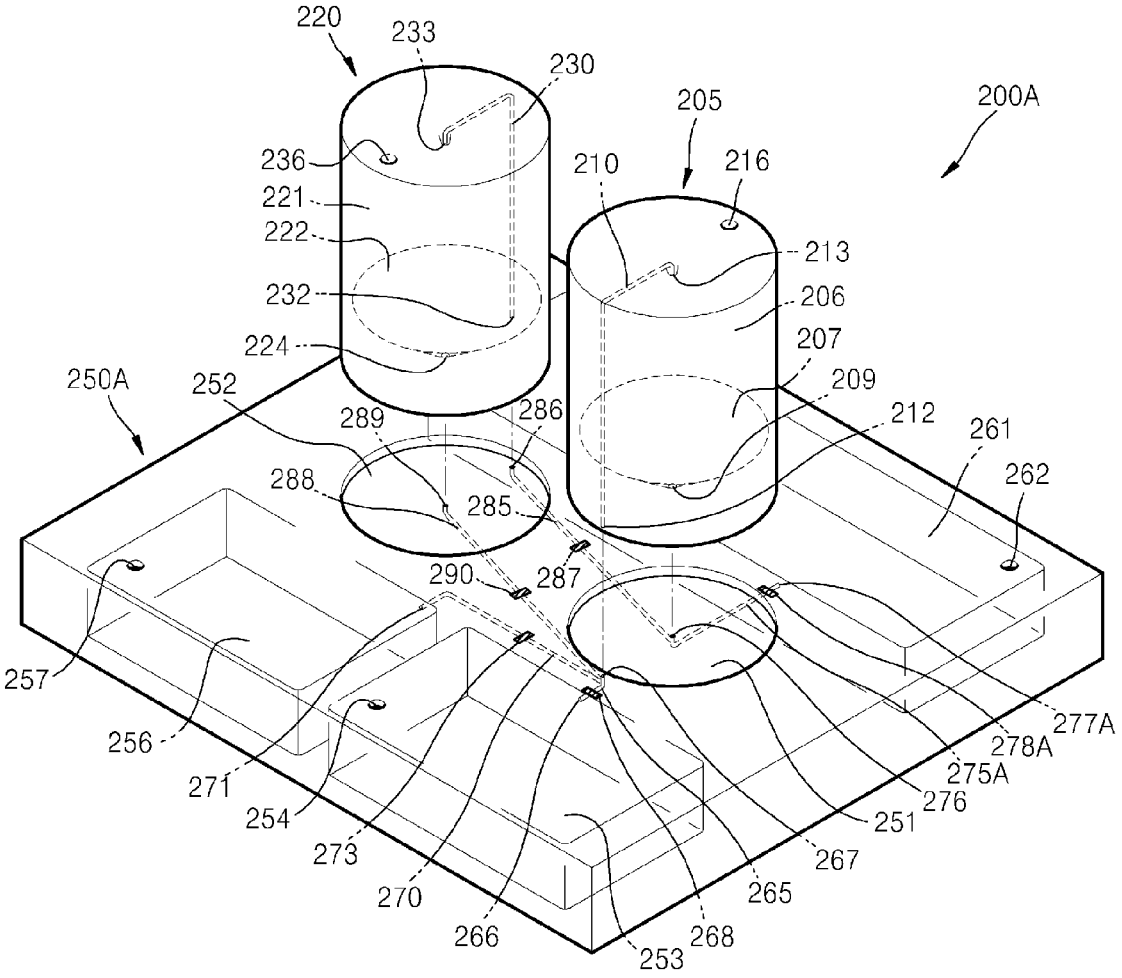
FIG. 3 is an exploded perspective view of another embodiment of a microfluidic device.
Figure 4:
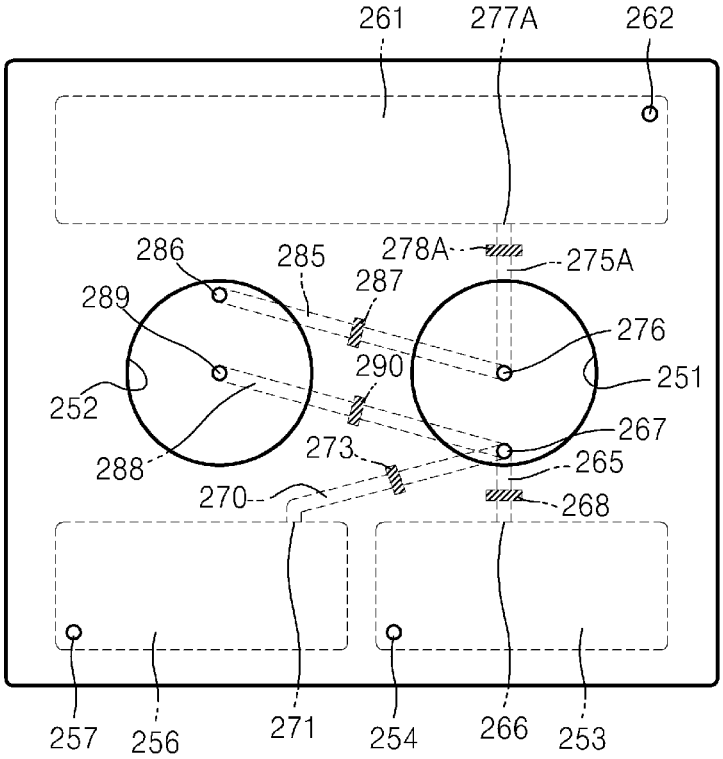
FIG. 4 is a top plan view of a chamber mounting member of the microfluidic device of FIG. 3.

FIG. 3 is an exploded perspective view of another embodiment of a microfluidic device 200A, and FIG. 4 is a top plan view of a chamber mounting member 250A of the microfluidic device 200A of FIG. 3.

Referring to FIGS. 3 and 4, the microfluidic device 200A may include a first fluid receiving chamber 205 and a second fluid receiving chamber 220, and a chamber mounting member 250A on which the first and second fluid receiving chambers 205 and 220 are disposed. Each of the first and second fluid receiving chambers 205 and 220 may have a structure same as the structure of the fluid receiving chamber 105 shown in FIGS. 1 and 2. The first and second fluid receiving chambers 205 and 220 may include inner spaces 206 and 221, fluid inlet holes 212 and 232, fluid supply holes 213 and 233, fluid outlet holes 209 and 224, inner channels 210 and 230, bottom surfaces 207 and 222 that are concaved and have a funnel-like shapes, and ventilation holes 216 and 236, respectively.

The chamber mounting member 250A of the microfluidic device 200A may include first and second mounting members 251 and 252 on which bottom ends of the first and second fluid receiving chambers 205 and 220 are disposed, e.g., fixed and mounted, respectively, first and second supply chambers 253 and 256 which contain different fluids to be supplied to the first fluid receiving chamber 205, respectively, and a drain chamber 261 that contains a fluid flown from the first fluid receiving chamber 205. The first and second supply chambers 253 and 256 have first and second openings 254 and 257, respectively, through which a fluid is loaded and the pressure inside the first and second supply chambers 253 and 256 and the pressure outside the first and second supply chambers 253 and 256 are maintained in equilibrium, respectively, and the drain chamber 261 has an opening 262 through which a fluid flows toward an outside of the drain chamber 261 and the pressure inside the drain chamber 261 and the pressure outside the drain chamber 261 are maintained in equilibrium.

In an embodiment, the chamber mounting member 250A may include a first fluid supply channel 265 that connects the first supply chamber 253 and the fluid inlet hole 212 of the first fluid receiving chamber 205, a second fluid supply channel 270 that connects the second supply chamber 256 and the fluid inlet hole 212 of the first fluid receiving chamber 205, and a fluid discharge channel 275A that connects the drain chamber 261 and the fluid outlet hole 209. First and second inlet holes 266 and 271, through which the first and second fluid supply channels 265 and 270 are connected to the first and second supply chambers 253 and 256, are formed at ends of the first and second fluid supply channels 265 and 270, respectively; and an outlet hole 267, which may be aligned with the fluid inlet hole 212 when the first fluid receiving chamber 205 is disposed on the first mounting member 251, is formed at the other ends of the first and second fluid supply channels 265 and 270. An outlet hole 277A, through which the fluid discharge channel 275A is connected to the drain chamber 261, is formed at one end of the fluid discharge channel 275A and an inlet hole 276 which may be aligned with the fluid outlet hole 209 when the first fluid receiving chamber 205 is disposed on the first mounting member 251, is formed at the other end of the discharge channel 275A.

In an embodiment, the chamber mounting member 250A may include a first connection channel 285 that connects the fluid outlet hole 209 of the first fluid receiving chamber 205 and the fluid inlet hole 232 of the second fluid receiving chamber 220 such that a fluid flows between the fluid outlet hole 209 of the first fluid receiving chamber 205 and the fluid inlet hole 232 of the second fluid receiving chamber 220, and a second connection channel 288 that connects the fluid inlet hole 212 of the first fluid receiving chamber 205 and the fluid outlet hole 224 of the second fluid receiving chamber 220 such that a fluid flows between the fluid inlet hole 212 of the first fluid receiving chamber 205 and the fluid outlet hole 224 of the second fluid receiving chamber 220. An end of the first connection channel 285 may be connected to the inlet hole 276 described above and at the other end of the first connection channel 285, an outlet hole 286, which may be aligned with the fluid inlet hole 232 when the second fluid receiving chamber 220 is disposed on the second mounting member 252, may be located. At one end of the second connection channel 288, the outlet hole 267 described above may be located; and at the other end of the second connection channel 288, an inlet hole 289, which may be aligned with the fluid outlet hole 224 when the second fluid receiving chamber 220 is disposed on the second mounting member 252, may be located.

The first and second fluid supply channels 265 and 270 may include first and second supply control valves 268 and 273, respectively, that control a flow of a fluid therein by opening or closing the first and second fluid supply channels 265 and 270, respectively, and the fluid discharge channel 275A may include a discharge control valve 278A which controls, e.g., opens or closes, the fluid discharge channel 275A. The first and second connection channels 285 and 288 may include first and second connection control valves 287 and 290, respectively, which control, e.g., open or close, the first and second connection channels 285 and 288, respectively.

An embodiment of a fluid mixing method using the microfluidic device 200A including the first and second fluid receiving chambers 205 and 220 may include first mixing fluids in the first fluid receiving chamber 205, first discharging the first mixed fluids through the fluid outlet hole 209 of the first fluid receiving chamber 205, second mixing the first mixed fluids in the second fluid receiving chamber 220, second discharging the second mixed fluids through the fluid outlet hole 224 of the second fluid receiving chamber 220, and additionally mixing the second mixed fluids in the first fluid receiving chamber 205.

In the first mixing, different fluids are loaded into the first and second supply chambers 253 and 256, respectively, the first and second supply control valves 268 and 273 are opened, the discharge control valve 278A and the first connection control valve 287 are closed, and then compressed air is provided to the first and second supply chambers 253 and 256 through the openings 254 and 257. As a result, the fluids of the first and second supply chambers 253 and 256 pass through the first and second fluid supply channels 265 and 270, respectively, the fluids are mixed while passing the inner channel 210, and then the fluids fill the inner space 206 of the first fluid receiving chamber 205 through the fluid supply hole 213. The fluids drop through the fluid supply hole 213, and the fluids are thereby rapidly mixed due to a vortex generated by the dropped fluids therein.

In the first discharging, the first connection control valve 287 is opened, the second connection control valve 290 and the first and second supply control valves 268 and 273 are closed, and the compressed air is loaded into the first fluid receiving chamber 205 through the ventilation hole 216. As a result, the first mixed fluids of the first fluid receiving chamber 205 are discharged through the fluid outlet hole 209. In the second mixing, the first mixed fluids that have been discharged through the fluid outlet hole 209 in the first discharging pass through the first connection channel 285 and the inner channel 230, and fill the inner space 221 of the second fluid receiving chamber 220 through the fluid supply hole 233. The first mixed fluids drop through the fluid supply hole 233, and the first mixed fluids are thereby substantially homogeneously mixed due to a vortex generated by the dropped fluids therein.

In the second discharging, the first connection control valve 287 is closed, the second connection control valve 290 is opened and the compressed air is loaded into the second fluid receiving chamber 220 through the ventilation hole 236. As a result, the second mixed fluids of the second fluid receiving chamber 220 are discharged through the fluid outlet hole 224. In the additionally mixing, the second mixed fluids discharged through the fluid outlet hole 224 in the second discharging pass through the second connection channel 288 and the inner channel 210, and fill the inner space 206 of the first fluid receiving chamber 205 through the fluid supply hole 213. The second mixed fluids drop through the fluid supply hole 213, and the second mixed fluids are thereby substantially homogeneously mixed due to a vortex generated by the dropped fluids therein.

The fluid contained in the inner space 206 of the first fluid receiving chamber 205 may be used for various purposes, e.g., various biochemical experiments, diagnosis, and detection for specific components, and when a target process is completely performed, the discharge control valve 278A is opened and the fluid of the inner space 206 may be discharged to the drain chamber 261 through the fluid discharge channel 275A. In another embodiment, although the number of the fluid receiving chambers included in the microfluidic device 200A illustrated in FIGS. 3 and 4 is two, the number of fluid receiving chambers may also be three or more. When a microfluidic device may include three or more fluid receiving chambers, an additional mixing may be performed in a third or other additional fluid receiving chambers.

Figure 5:
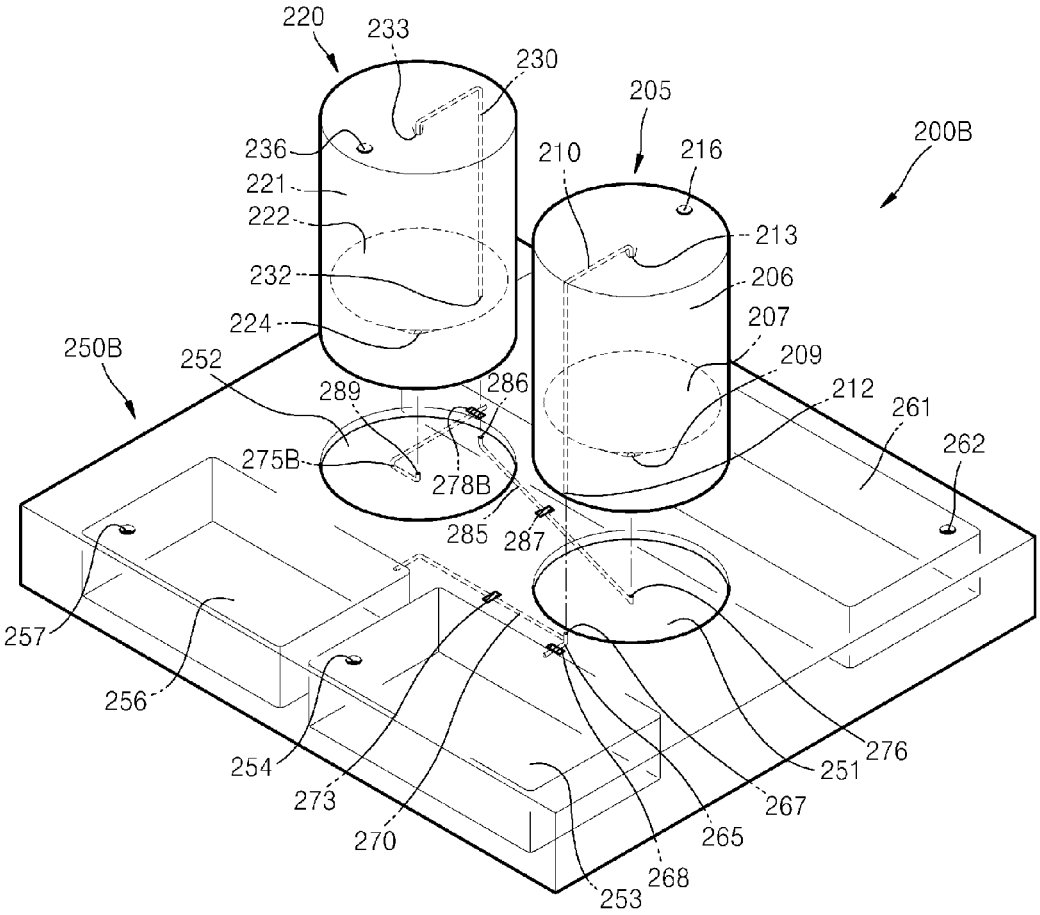
FIG. 5 is an exploded perspective view of yet another embodiment of a microfluidic device.

FIG. 5 is an exploded perspective view of yet another embodiment of a microfluidic device 200B. The microfluidic device 200B of FIG. 5 is substantially the same as the microfluidic device 200A of FIG. 3. The same or like elements shown in FIG. 5 have been labeled with same or like reference numerals as used above to describe the embodiment of the microfluidic device 200A shown in FIG. 3, and any repetitive detailed description thereof will hereinafter be omitted or simplified.

Referring to FIG. 5, like the microfluidic device 200A illustrated in FIG. 3, the microfluidic device 200B may include the first and second fluid receiving chambers 205 and 220 and a chamber mounting member 250B on which the first and second fluid receiving chambers 205 and 220 are disposed. The chamber mounting member 250B may include the first mounting members 251 and 252 on which bottom ends of the first and second fluid receiving chambers 205 and 220 are disposed, e.g., fixed and mounted, the first and second supply chambers 253 and 256 which respectively contain different fluids, and the drain chamber 261 that contains a fluid discharged from the second fluid receiving chamber 220.

The chamber mounting member 250B may include the first fluid supply channel 265 that connects the first supply chamber 253 and the fluid inlet hole 212 of the first fluid receiving chamber 205, the second fluid supply channel 270 that connects the second supply chamber 256 and the fluid inlet hole 212, and a fluid discharge channel 275B that connects the drain chamber 261 and the fluid outlet hole 224. When the first fluid receiving chamber 205 is disposed, e.g., fixed and mounted, on the first mounting member 251, the fluid inlet hole 212 is disposed corresponding to, e.g., aligned with, the outlet hole 267 formed at ends of the first and second fluid supply channels 265 and 270. When the second fluid receiving chamber 220 is disposed, e.g., fixed and mounted, on the second mounting member 252, the fluid outlet hole 224 is disposed corresponding to, e.g., aligned with, the inlet hole 289 formed at an end of the fluid discharge channel 275B. In an embodiment, the chamber mounting member 250B may include a first connection channel 285 that connects a fluid outlet hole 209 of the first fluid receiving chamber 205 and the fluid inlet hole 232 of the second fluid receiving chamber 220 such that a fluid flows between the fluid outlet hole 209 of the first fluid receiving chamber 205 and the fluid inlet hole 232 of the second fluid receiving chamber 220. An inlet hole 276, which may be disposed corresponding to, e.g., aligned with, the fluid outlet hole 209 when the first fluid receiving chamber 205 is disposed, e.g., mounted, on the first mounting member 251, is formed at one end of the first connection channel 285, and an outlet hole 286, which may be disposed corresponding to, e.g., aligned with, the fluid inlet hole 232 when the second fluid receiving chamber 220 is disposed, e.g., mounted, on the second mounting member 252, is formed at the other end of the first connection channel 285.

The first and second fluid supply channels 265 and 270 may include first and second supply control valves 268 and 273, respectively, that control a flow of a fluid in the first and second fluid supply channels 265 and 270, e.g., open or close the first and second fluid supply channels 265 and 270, respectively, and the fluid discharge channel 275B may include a discharge control valve 278B that controls a flow of a fluid in the fluid discharge channel 275B, e.g., opens or closes the fluid discharge channel 275B. In an embodiment, the first connection channel 285 may include a first connection control valve 287 that controls a flow of a fluid in the first connection channel 285, e.g., opens or closes the first connection channel 285.

Another embodiment of a fluid mixing method using the microfluidic device 200B including the first and second fluid receiving chambers 205 and 220 may include first mixing fluids in the first fluid receiving chamber 205, first discharging the first mixed fluids through the fluid outlet hole 209 of the first fluid receiving chamber 205, and second mixing the first mixed fluids in the second fluid receiving chamber 220.

In the first mixing, different fluids are loaded into the first and second supply chambers 253 and 256, respectively, the first and second supply control valves 268 and 273 are opened, the first connection control valve 287 is closed, and then compressed air is provided to the first and second supply chambers 253 and 256 through the openings 254 and 257. As a result, the fluids of the first and second supply chambers 253 and 256 pass through the first and second fluid supply channels 265 and 270, respectively, the fluids are mixed each other while passing an inner channel 210, and then the fluids fill an inner space 206 of the first fluid receiving chamber 205 through a fluid supply hole 213. The fluids drop through the fluid supply hole 213, and the fluids are thereby substantially rapidly mixed due to a vortex generated by the dropped fluids therein.

In the first discharging, the first connection control valve 287 is opened, the first and second supply control valves 268 and 273 are closed and the compressed air is loaded into the first fluid receiving chamber 205 through a ventilation hole 216. As a result, the first mixed fluids of the first fluid receiving chamber 205 are discharged through the fluid outlet hole 209. In the second mixing, the discharge control valve 278B is closed. The first mixed fluids that have been discharged through the fluid outlet hole 209 pass through the first connection channel 285 and the inner channel 230, and fill an inner space 221 of the second fluid receiving chamber 220 through a fluid supply hole 233. The first mixed fluids drop through the fluid supply hole 233, and the first mixed fluids are thereby substantially homogeneously mixed due to a vortex generated by the dropped fluids therein.

The fluid housed in the inner space 221 of the second fluid receiving chamber 220 may be used for various purposes, e.g., various biochemical experiments, diagnosis, and detection for specific components, and when a target process is completely performed, the discharge control valve 278B is opened and the second mixed fluids in the inner space 206 may be discharged to the drain chamber 261 through the fluid discharge channel 275B.

The general inventive concept should not be construed as being limited to the example embodiments set forth herein. Rather, these example embodiments are provided so that this disclosure will be thorough and complete and will fully convey the concept of the general inventive concept to those of ordinary skill in the art.

While the general inventive concept has been particularly shown and described with reference to example embodiments thereof, it will be understood by those of ordinary skill in the art that various changes in form and details may be made therein without departing from the spirit or scope of the general inventive concept as defined by the following claims.

What is claimed is:

1. A fluid receiving chamber comprising:

an inner space delimited by a top surface and a bottom surface opposite the top surface, wherein the bottom surface has a funnel-like shape;

a fluid supply hole in the top surface;

a fluid inlet hole in a bottom end of the fluid receiving chamber through which a fluid is introduced from outside the fluid receiving chamber into the fluid receiving chamber;

a micro channel which connects the fluid inlet hole to the fluid supply hole;

a fluid outlet hole disposed at the lowest point of the bottom surface and extending through the bottom end of the fluid receiving chamber through which fluid in the inner space is discharged;

wherein the fluid inlet hole and the fluid outlet hole are in the same plane;

the fluid supply hole is disposed above the fluid outlet hole, and configured so that fluid supplied to the inner space through the fluid supply hole flows to the fluid outlet hole by gravity; and the fluid receiving chamber is configured to be used with a microfluidic device.

2. The fluid receiving chamber of claim 1, wherein the micro channel which connects the fluid inlet hole and the fluid supply hole is disposed in a wall of the fluid receiving chamber.

3. The fluid receiving chamber of claim 1, wherein the fluid supply hole has a nozzle-like shape having a diameter which decreases in a direction of a flow of the fluid therethrough.

4. A microfluidic device comprising:

a fluid receiving chamber comprising:

an inner space having a top surface and a bottom surface opposite the top surface, wherein the bottom surface has a funnel-like shape;

a fluid supply hole in the top surface;

a fluid inlet hole in a bottom end of the fluid receiving chamber through which a fluid is introduced to the fluid receiving chamber;

a channel which connects the fluid inlet hole to the fluid supply hole;

a fluid outlet hole disposed at the lowest point of the bottom surface and extending through the bottom end of the fluid receiving chamber through which fluid in the inner space is discharged, and a chamber mounting member on which the fluid receiving chamber is disposed comprising:

a fluid supply channel connected to the fluid inlet hole and through which a fluid is supplied to the fluid receiving chamber, a fluid discharge channel connected to the fluid outlet hole and through which the fluid is discharged from the fluid receiving chamber, a supply control valve disposed in the fluid supply channel and which controls a flow of the fluid in the fluid supply channel, and a discharge control valve disposed in the fluid discharge channel and which controls a flow of the fluid in the fluid discharge channel, wherein the fluid supply hole is disposed above the fluid outlet hole, and configured so that fluid supplied to the inner space through the fluid supply hole flows to the fluid outlet hole by gravity.

5. The microfluidic device of claim 4, wherein the channel which connects the fluid inlet hole and the fluid supply hole is disposed in a wall of the fluid receiving chamber.

6. The microfluidic device of claim 4, wherein the fluid supply hole has a nozzle-like shape having a diameter which decreases in a direction of a flow of the fluid therethrough.

7. A microfluidic device comprising:

a plurality of fluid receiving chambers, each fluid receiving chamber of the plurality of fluid receiving chambers comprising:

an inner space having a top surface and a bottom surface opposite the top surface, wherein the bottom surface has a funnel-like shape;

a fluid supply hole in the top surface;

a fluid inlet hole in a bottom end of the fluid receiving chamber through which a fluid is introduced to the fluid receiving chamber;

a channel which connects the fluid inlet hole to the fluid supply hole;

a fluid outlet hole disposed at the lowest point of the bottom surface and extending through the bottom end of the fluid receiving chamber through which fluid in the inner space is discharged, and a chamber mounting member comprising:

a plurality of mounting members on which the plurality of fluid receiving chambers are disposed, a fluid supply channel connected to the fluid inlet hole of a first fluid receiving chamber of the plurality of fluid receiving chambers and through which the fluid is supplied to the first fluid receiving chamber, a fluid discharge channel connected to the fluid outlet hole of the first fluid receiving chamber and through which the fluid is discharged from the first fluid receiving chamber, a connection channel which connects the fluid outlet hole of the first fluid receiving chamber and the fluid inlet hole of a second fluid receiving chamber of the plurality of fluid receiving chambers, a supply control valve disposed in the fluid supply channel and which controls a flow of the fluid in the fluid supply channel, a discharge control valve disposed in the fluid discharge channel and which controls a flow of the fluid in the fluid discharge channel, and a connection control valve disposed in the connection channel and which controls a flow of the fluid in the connection channel, wherein the fluid supply hole is disposed above the fluid outlet hole, and configured so that fluid supplied to the inner space through the fluid supply hole flows to the fluid outlet hole by gravity.

8. The microfluidic device of claim 7, wherein for each fluid receiving chamber of the plurality of fluid receiving chambers, the channel which connects the fluid inlet hole and the fluid supply hole is disposed within a wall of the fluid receiving chamber.

9. The microfluidic device of claim 7, wherein the fluid supply hole of each fluid receiving chamber has a nozzle-like shape having a diameter which decreases in a direction of a flow of the fluid therethrough.

10. A method of mixing fluid using microfluidic device, the method comprising:

mixing a plurality of kinds of fluids by loading the fluids through the fluid inlet hole of a first fluid receiving chamber of the plurality of fluid receiving chambers of the microfluidic device of claim 9 and supplying the fluids to the inner space of the first fluid receiving chamber;

discharging the first mixed fluids through the fluid outlet hole of the first fluid receiving chamber; and further mixing the first mixed fluids by loading the discharged first mixed fluids through the fluid inlet hole of a second fluid receiving chamber of the plurality of fluid receiving chambers and supplying the loaded first mixed fluids to the inner space of the second fluid receiving chamber.

11. The fluid mixing method of claim 10, further comprising:

discharging the fluids mixed in the second fluid receiving chamber through the fluid outlet hole of the second fluid receiving chamber; and further mixing the discharged fluids by loading the fluids through the fluid inlet hole of the first fluid receiving chamber and supplying the loaded fluids to the inner space of the first fluid receiving chamber.

12. The fluid mixing method of claim 10, further comprising:

discharging the fluids mixed in the second fluid receiving chamber mixing through the fluid outlet hole of the second fluid receiving chamber; and further mixing the discharged fluids by loading the fluids through the fluid inlet hole of a third fluid receiving chamber and supplying the loaded fluids to the inner space of the third fluid receiving chamber.

* * * * *